US008584262B2

(12) United States Patent
Ekelund et al.

(10) Patent No.: US 8,584,262 B2
(45) Date of Patent: Nov. 19, 2013

(54) BIB

(75) Inventors: Ronnie Michael Ekelund, Monte Sereno, CA (US); Steve Denny, Watsonville, CA (US)

(73) Assignee: Bebe au Lait LLC, Los Gatos, CA (US)

( * ) Notice: Subject to any disclaimer, the term of this patent is extended or adjusted under 35 U.S.C. 154(b) by 0 days.

(21) Appl. No.: 12/848,080

(22) Filed: Jul. 30, 2010

(65) Prior Publication Data

US 2011/0016600 A1 Jan. 27, 2011

Related U.S. Application Data

(63) Continuation of application No. 12/502,995, filed on Jul. 14, 2009, now Pat. No. 7,784,108.

(60) Provisional application No. 61/135,064, filed on Jul. 15, 2008.

(51) Int. Cl.
*A41B 13/10* (2006.01)

(52) U.S. Cl.
USPC ..... 2/49.1; 2/49.4

(58) Field of Classification Search
USPC ..... 2/49.1–49.5, 88, 104, 207, 91, 114, 2/102, 92, 46, 93, 95, 49.4, 48–52, 106, 2/174, 69, 69.5, 85; D2/860–862
See application file for complete search history.

(56) References Cited

U.S. PATENT DOCUMENTS

| | | | | | |
|---|---|---|---|---|---|
| 514,720 | A | | 2/1894 | MacGowan | |
| 797,434 | A | | 8/1905 | Homeyer | |
| 885,872 | A | * | 4/1908 | Scott | 2/91 |
| 985,441 | A | * | 2/1911 | Neuman | 2/91 |
| 1,096,549 | A | * | 5/1914 | Mandel et al. | 2/91 |
| 2,237,368 | A | * | 4/1941 | Seitzman et al. | 2/91 |
| 2,319,292 | A | * | 5/1943 | Boggs | 2/96 |
| 2,402,996 | A | * | 7/1946 | Geissmann | 2/91 |
| D167,406 | S | * | 8/1952 | Kairalla | D2/823 |
| 2,629,870 | A | | 3/1953 | Hudson | |
| 2,635,243 | A | * | 4/1953 | Eskey | 2/49.2 |
| 2,682,055 | A | * | 6/1954 | La Doux | 2/48 |
| 2,690,563 | A | * | 10/1954 | Wilson | 2/49.1 |
| 2,804,626 | A | * | 9/1957 | Rossiter | 2/91 |
| 2,809,375 | A | | 10/1957 | Doron | |

(Continued)

FOREIGN PATENT DOCUMENTS

| | | | |
|---|---|---|---|
| CA | 2339333 | | 9/2002 |
| JP | 2004244782 | * | 9/2004 |
| JP | 2007063731 | * | 3/2007 |
| WO | WO 2007/079523 | * | 7/2007 |

OTHER PUBLICATIONS

English language translation of Japanese Patent Doc. JP 2004244782 (machine translation), 17 pages.*

(Continued)

*Primary Examiner* — Amy Vanatta

(74) *Attorney, Agent, or Firm* — Blakely, Sokoloff, Taylor & Zafman LLP; Judith A. Szepesi

(57) ABSTRACT

A bib is described that includes multiple flaps, each flap providing a surface to prevent soiling of clothing. The flaps are secured to one another through multiple fastening mechanisms, which may include one or more magnets. A neck bridge portion couples the plurality of flaps to one another.

21 Claims, 9 Drawing Sheets

(56) References Cited

U.S. PATENT DOCUMENTS

| | | | | | |
|---|---|---|---|---|---|
| 2,832,075 | A | * | 4/1958 | Davidson | 2/91 |
| 2,914,771 | A | * | 12/1959 | Slavin | 2/48 |
| 3,016,544 | A | * | 1/1962 | Pinkney | 2/49.1 |
| 3,141,175 | A | * | 7/1964 | Heater et al. | 2/74 |
| 3,879,762 | A | * | 4/1975 | Herman | 2/48 |
| D275,827 | S | | 10/1984 | Henry | |
| D277,352 | S | | 1/1985 | Klein | |
| D343,498 | S | | 1/1994 | Donahue | |
| 5,321,863 | A | | 6/1994 | Yamaguchi et al. | |
| 5,490,289 | A | * | 2/1996 | Lehrer | 2/49.2 |
| 5,572,740 | A | | 11/1996 | Geniesse | |
| 5,727,489 | A | | 3/1998 | Braverman | |
| D408,966 | S | | 5/1999 | Lawrence | |
| D410,382 | S | | 6/1999 | Therriault | |
| 6,021,521 | A | * | 2/2000 | Baratta | 2/49.1 |
| 6,156,410 | A | | 12/2000 | Bassler | |
| D448,540 | S | * | 10/2001 | Smith | D2/502 |
| D456,661 | S | | 5/2002 | Henegan | |
| 6,389,597 | B1 | | 5/2002 | Henegan | |
| 6,594,829 | B1 | | 7/2003 | Turkheimer | |
| 6,986,163 | B2 | | 1/2006 | Dugan | |
| 7,065,810 | B2 | | 6/2006 | Robinson | |
| 7,178,185 | B1 | * | 2/2007 | Nattler | 5/482 |
| 7,380,284 | B1 | | 6/2008 | Dodani | |
| 7,448,089 | B2 | * | 11/2008 | Kelly | 2/49.1 |
| 7,469,424 | B2 | * | 12/2008 | Good et al. | 2/49.1 |
| D594,184 | S | * | 6/2009 | Mitchell | D2/864 |
| 7,540,036 | B1 | * | 6/2009 | Paulsen | 2/49.1 |
| 7,566,328 | B2 | * | 7/2009 | Hooper | 604/357 |
| 2002/0108162 | A1 | | 8/2002 | Bolds-Leftridge | |
| 2003/0079267 | A1 | | 5/2003 | Dugan | |
| 2003/0135908 | A1 | | 7/2003 | Turkheimer | |
| 2003/0196240 | A1 | | 10/2003 | Meacham et al. | |
| 2005/0015881 | A1 | | 1/2005 | Littlehorn | |
| 2005/0204501 | A1 | | 9/2005 | Golec | |
| 2006/0010569 | A1 | * | 1/2006 | Tawfik | 2/207 |
| 2006/0059597 | A1 | * | 3/2006 | LaRocco | 2/49.1 |
| 2006/0282931 | A1 | | 12/2006 | Greear Astaud et al. | |
| 2007/0049147 | A1 | | 3/2007 | Hill et al. | |
| 2008/0005824 | A1 | | 1/2008 | Seckinger | |
| 2009/0000005 | A1 | * | 1/2009 | Amson | 2/48 |

OTHER PUBLICATIONS

PCT/US2009/050674, International Search Report and Written Opinion, Sep. 1, 2009, 8 pages.

PCT/US2009/050674, International Preliminary Report on Patentability, Jan. 18, 2011, 5 pages.

EP 09798695.4, Supplementary European Search Report, Dated Jun. 6, 2012, 8 pages.

* cited by examiner

BIB

CROSS-REFERENCE TO RELATED APPLICATIONS

This application is a continuation of U.S. patent application Ser. No. 12/502,995, filed Jul. 14, 2009 entitled "BIB," which claims priority to U.S. Patent Application No. 61/135,064, filed Jul. 15, 2008 entitled "BIB," all of which are hereby incorporated by reference.

FIELD OF THE INVENTION

The present invention relates generally to clothing and, more specifically, a bib is described.

BACKGROUND OF THE INVENTION

Conventional bibs are useful to protect clothing. However, conventional bibs are problematic in that placement and securing are often difficult, are easily extracted, pulled, or otherwise removed, and have limited surfaces for protection.

Conventional bibs are difficult to place and secure around the neck of the wearer (e.g., adult, child, infant, toddler, or the like). Conventional bibs are generally secured to a wearer by approaching the wearer from the front, wrapping a strap or clasp around the neck of the wearer and engaging a fastening device behind the neck of the wearer. Often, when attempting to place and secure a conventional bib as described, the wearer typically offers resistance to the placement of the bib, or the wearer begins to wrestle or play resulting in placement of the bib becoming very difficult and time consuming. Additionally, conventional bibs do not prevent self-removal by a wearer. Because a conventional bib is secured behind a wearer, the wearer may easily pull downward on the bib, which may exert a force sufficient to release the fastener. When a conventional bib is easily removed by the wearer, the result can be tedious and time-consuming labor to clean clothing, the wearer, surrounding areas, and, in many cases, the bib. Finally, conventional bibs offer limited surfaces to prevent soiling of clothing. Once a conventional bib has been used once, it typically requires cleaning or wiping before it can be used effectively again.

Thus, a solution for protecting clothing without the limitations of conventional techniques is needed.

BRIEF DESCRIPTION OF THE DRAWINGS

Various examples are disclosed in the following detailed description and the accompanying drawings.

DETAILED DESCRIPTION

Embodiments or examples of the invention may be implemented in numerous ways, including as an apparatus, system, or process. A detailed description of one or more examples is provided below along with accompanying figures. The detailed description is provided in connection with such examples, but is not limited to any particular example. The scope is limited by the claims, but numerous alternatives, modifications, and equivalents are encompassed. Numerous specific details are set forth in the following description in order to provide a thorough understanding. These details are provided for the purpose of example and the descriptions provided may be used for implementation according to the claims without some or all of these specific details. For the purpose of clarity, technical material that is known in the technical fields related to the examples has not been described in detail to avoid unnecessarily obscuring the description.

A bib is described, including one or more flaps or panels ("flaps") coupled together with a neck bridge or collar ("neck bridge"), each flap having a magnet or other fastener to secure one flap to another. In some examples, magnets may be placed within one or more interior pockets or spaces of each flap and, when placed adjacent to another magnet's opposite pole, magnetic force causes the flaps to bind to each other, allowing a bib to be secured about the neck of a wearer. In other examples, multiple magnets may be placed to provide multiple points of contact and securing flaps to each other. Further, a bib, such as those described herein, may be draped about the collar or neck region of a wearer, initiating placement from behind a wearer, resulting in placement of the flaps on the front or chest region of a wearer. In other examples, the described bibs may be varied in design, function, structure, or implementation and are not limited to the techniques described below.

Figure 1:
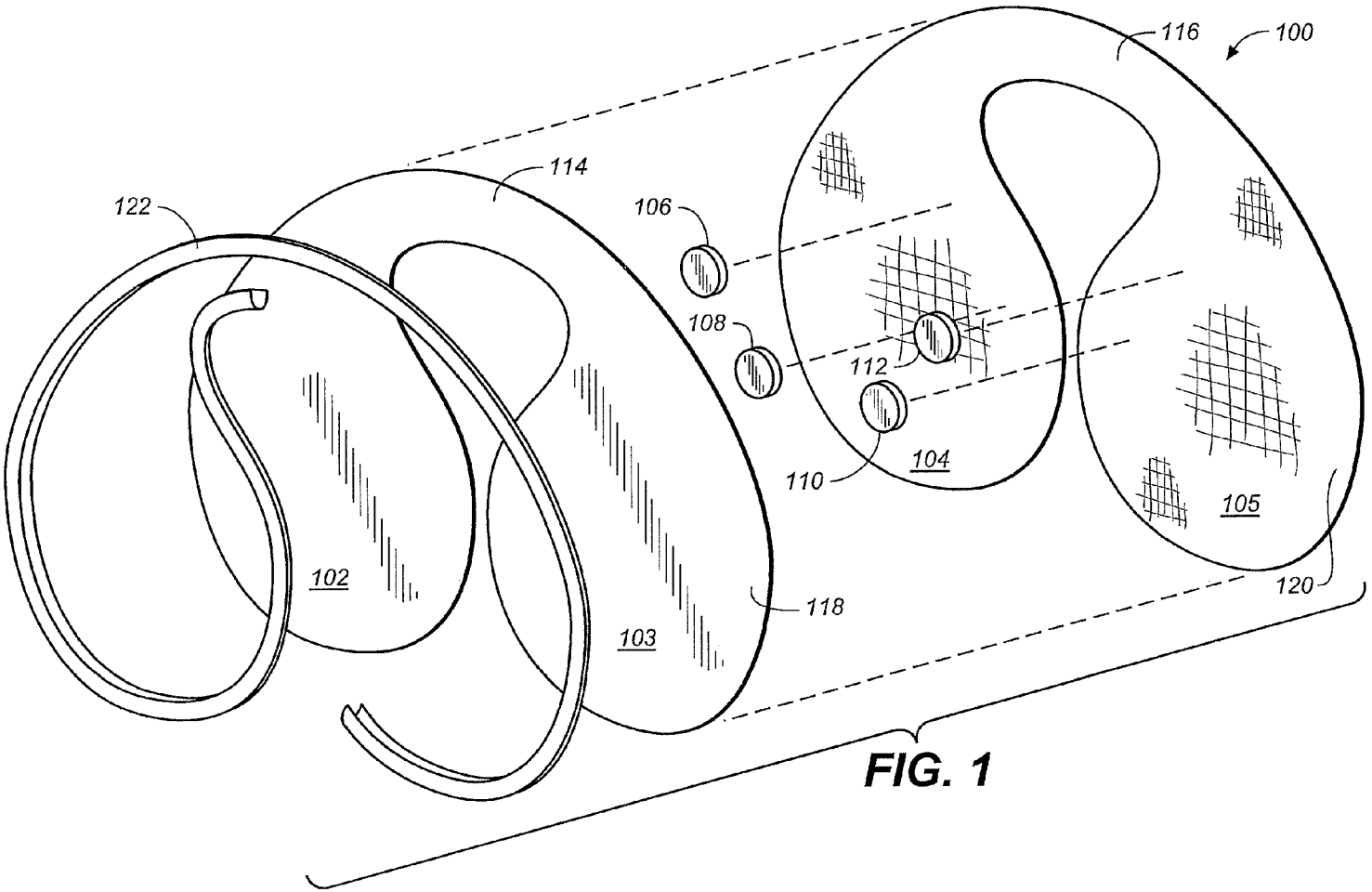
FIG. 1 illustrates an exploded perspective view of an exemplary bib.

FIG. 1 illustrates an exploded perspective view of an exemplary bib. Here, bib 100 is shown in an exploded view with flaps 102-105, magnets 106-112, neck bridges 114-116, outer surface 118, reverse surface 120, and fabric 122. As shown here, outer surface 118 comprises flaps 102-103 and neck bridge 114. In some examples, outer surface 118 and reverse surface 120 may be reversible. For example, when outer surface 118 is placed over magnets 106-112 and coupled to reverse surface 120, bib 100 may be used in different configurations to provide up to four surfaces (e.g., flaps 102-105) to protect the wearer from coming into contact with unwanted material (e.g., food, liquids, and the like). Still further, bib 100 may be reversed entirely, allowing the use of the reverse surfaces of outer surface 100 and reverse surface 120. Further, reverse surface 120 includes flaps 104-105 and neck bridge 116, and, as an example, is the "back" side of bib 100 when worn.

As shown here, flaps 102-105 may be a substantially rounded shape. In other examples, flaps 102-105 may be implemented using a circular, square, rectangular, triangular, parabolic or other geometric shape or design. As shown here, flap 102 may be symmetrical with flap 103 and flap 104 may be symmetrical with flap 105. In other examples, flap 102 may be asymmetrical with flap 103 and flap 104 may be asymmetrical with flap 105. In still other examples, flaps 102-105 may be designed and implemented differently than as shown and described. As shown here, neck bridges 114-116 are implemented to connect, couple or attach flap 102 to flap 103 and flap 104 to flap 105. Neck bridges 114-116 may be separate components from flaps 102-105, or may be integrated as one singular member. For example, flap 102, flap 103 and neck bridge 114 may be formed from one piece of material, such as a piece of fabric. As another example, flap 102, flap 103 and neck bridge 114 may be formed from separate materials and attached or coupled together by sewing, stitching, tying, knitting, knotting, gluing or other method of connection. In some examples, neck bridges 114-116 may be tapered. In other examples, the shape and configuration of flaps 102-105 and neck bridges 114-116 may be implemented differently and are not limited to the examples shown and described.

As shown here, magnets 106-112 may be composed of any material configured to produce a magnetic field or magnetically attractive force. Magnets 106-112 may have any magnetic field strength or intensity. In some examples, magnets 106-112 may be rounded, circular, square, rectangular, triangular, or implemented using any other geometric shape or design. In other examples, magnets 106-112 may be any size, dimension or shape and are not limited to the examples shown and described. In some examples, magnets 106-112 may be directly attached or coupled to outer surface 118 or reverse surface 120 (as indicated by the dashed lines) by sewing, stitching, tying, knitting, knotting, gluing or using any other type or method of connection, coupling, or adhesion. In some examples, magnets 106-112 may be placed between outer surface 118 and reverse surface 120, enabling the magnets to remain protected from exposure from food or other materials that may come into contact with bib 100. When washed, magnets 106-112 may be configured to provide a magnetically attractive force to couple one or more of flaps 102-105 to each other. Further, the placement of magnets 106-112 may be varied and are not limited to the examples shown. For example, magnets 106-112 may be positioned at the upper or lower corners of each of flaps 102-105. As another example, magnets 106-112 may be positioned in the center, along the outer, top, bottom, or inner edges of flaps 102-105. Still further, magnets 106-112 may be positioned differently than as shown and described. In other examples, magnets 106-112 may be disposed in an interior pocket (not shown) formed between outer surface 118 and reverse surface 120, the interior pocket being bounded by stitches or otherwise enclosed. In some examples, magnets 106-112 may be replaced with another fastener such as buttons, snaps, Velcro, or other mating device implemented to detachably couple and secure flaps 102-105. Further, in some examples, no closures may be used. In other examples, magnets 106-112 may be implemented differently and are not limited to the examples shown and described.

In some examples, outer surface 118, reverse surface 120, flaps 102-105 and neck bridges 114-116 may be implemented using any type of fabric made from natural or synthetic fibers, including cotton, terry cloth, wool, silk, denim, polyester, nylon, various types of blends, or others. Materials used for outer surface 118, reverse surface 120, flaps 102-105 and neck bridges 114-116 may be magnetic, waterproof, water resistant, water repellant or absorbent. Further, outer surface 118, reverse surface 120; flaps 102-105 and neck bridges 114-116 may be covered with a coating or finish that is magnetic, waterproof, water resistant, or water repelling. As an example, terry cloth may be used for reverse surface 118 to provide a soft or non-abrading surface against the wearer's skin, and absorbency to assist with cleaning up liquids or other substances. Further, various types of designs may be placed on outer surface 118, reverse surface 120, flaps 102-105 and neck bridges 114-116 using any type of technique such as silk-screening, embroidery, or forming patterns or designs within a weave of the fabric. In some examples, the "front" side (i.e., outer surface 118) and the "back" side (i.e., reverse surface 120) of the bib may be implemented using the same material. In other examples, the "front" side and the "back" side of the bib may be implemented using different, similar, or a combination of materials. Other types of fabrics and designs may be used and are not limited to the examples provided.

As shown here, fabric 122 is wrapped around outer surface 118 and reverse surface 120, to couple flaps 102-103 to flaps 104-105 and neck bridge 114 to neck bridge 116. In some examples, fabric 122 may be any type of fabric made from any natural or synthetic fiber, including cotton, terry cloth, wool, silk, denim, polyester, nylon, and various types of blends. In some examples, fabric 122 may be a decorative material. In other examples, fabric 122 may cover ragged edges and provide bib 100 with a border around the outside perimeter of bib 100. In still other examples, fabric 122 may be an absorbent material configured to serve as a burp cloth or to assist with cleaning up spilled food, drinks, paints or otherwise. In some examples, fabric 122 may be a rigid, semi-rigid or shape retaining material configured to provide the perimeter of flaps 102-105 or neck bridges 114-116 with support to maintain a shape. In other examples, fabric 122 may enclose a stiffener (not shown), configured to also maintain or retain the shape of flaps 102-105 and neck bridges 114-116. In other examples, fabric 122 may be configured differently, and may serve a different purpose and is not limited to the configurations and implementations described.

In some examples, fabric 122 may be implemented using similar or substantially similar material as used for flaps 102-105 and neck bridges 114-116 or, alternatively, different material may be used apart from that used for flaps 102-105. As shown here, fabric 122 is attached to flap 102-105 or neck bridges 114-116 by sewing, stitching, tying, knitting, knotting, gluing or other method of connection. In other examples, the above-described elements may be implemented differently and are not limited to the examples shown and described.

Figure 2A:
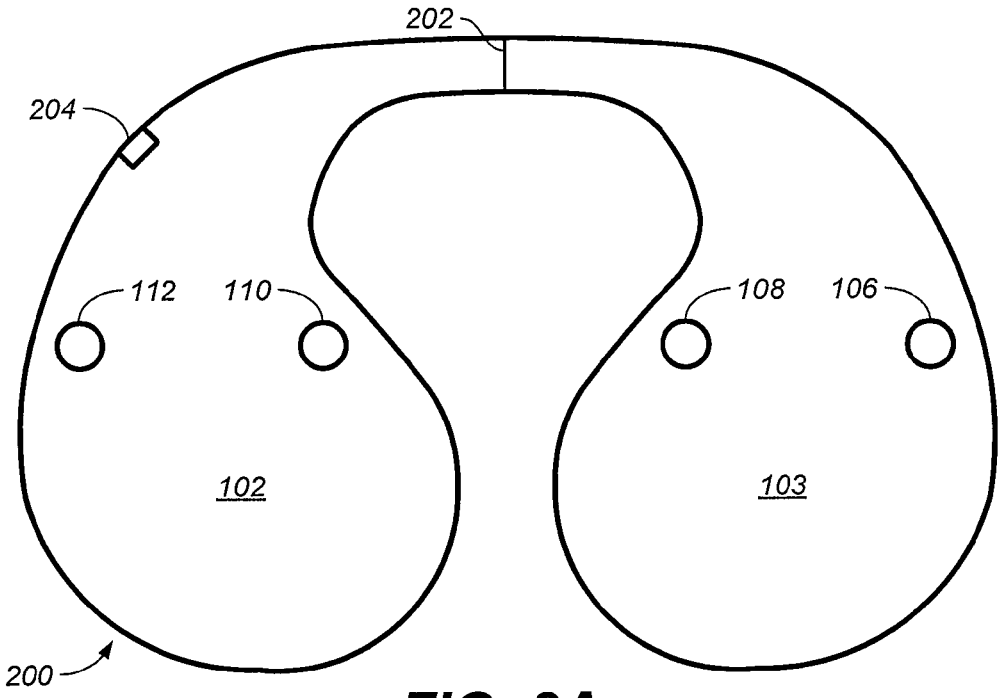
FIG. 2A illustrates an alternative view of an exemplary bib.

FIG. 2A illustrates an alternative view of an exemplary bib. Here, bib 200 may include flaps 102-103, magnets 106-112, neck bridge 202, and label 204 (e.g., use and care label). In some examples, flaps 102-103 may be implemented similarly or substantially similar in function and structure to flaps 102-103 as shown and described in FIG. 1. Further, magnets 106-112 may be implemented similarly or substantially similar in function and structure to magnets 106-112 as shown and described in FIG. 1. Still further, neck bridge 202 may be implemented similarly or substantially similar in function and structure to neck bridges 114-116 as shown and described in FIG. 1

As shown here, label 204 is located on flap 102 and may be positioned in any location on bib 200. In other examples, label 204 may be located or placed on neck bridge 202, flap 103, outer surface 100, reverse surface 101, flaps 104-105 (as shown in FIG. 1), or any other location on bib 200. In some examples, label 204 may be attached, connected, or coupled to bib 200 by sewing, stitching, tying, knitting, knotting, gluing or using any other method or type of connection, coupling, or adhesion. Label 204 may be implemented using any fabric (e.g., natural or synthetic fibers, including cotton, terry cloth, wool, silk, denim, polyester, nylon, and various types of blends) and may be implemented using any size, shape or color. In some examples, label 204 may be imprinted with instructions, directions, intellectual property notices, or any other type of information in any language. In other examples, label 204 may be implemented and configured differently and is not limited to the descriptions provided.

In some examples, bib 200 may be used to prevent a wearer from soiling, dirtying, staining, contaminating or otherwise ruining their clothing or other garments. The wearer (e.g., adult, child, infant, toddler, or the like), may use bib 200 while eating, drinking, painting, drawing, or the like. Bib 200 may be used to protect clothing from stains that may be caused by foods, drinks, spit-up, saliva, vomit, or the like while the user is eating or drinking. Bib 200 may be used to protect clothing from stains that may be caused by paint, markers, crayons, pens, pencils, ink, or the like, while the user is painting or drawing. As an example, bib 200 may be placed on a child while eating dinner to cover the child's clothing and prevent baby food from contacting and possibly staining the clothing. In other examples, bib 200 may be used differently and is not limited to the descriptions provided.

In some examples, bib 200 may be placed to cover the upper torso of the wearer by wrapping bib 200 around the neck of the wearer. Neck bridge 202 may be placed behind the back of wearer's neck while flaps 102-103 may be overlapped and placed upon the upper torso of the wearer. In some examples, magnets 106-112 may be used to secure placement of bib 200 by fastening flap 102 to flap 103. When placed as described above, a wearer cannot remove, take-off, extract, pull, or otherwise remove bib 200 by pulling flaps 102-103 downward.

In some examples, bib 200 may be placed on a wearer in, for example, four (4) different configurations to provide different protective surfaces. For example, bib 200 may be placed on wearer with outer surface 100 (as shown in FIG. 1) facing "out" by overlapping flap 103 on top of flap 102 or by overlapping flap 102 on top of flap 103. As another example, bib 200 may be placed on wearer with reverse surface 101 (as shown in FIG. 1) facing "out" by overlapping flap 104 (as shown in FIG. 1) on top of flap 105 (as shown in FIG. 1) or by overlapping flap 105 on top of flap 104. In each of the examples provided, magnets 106-112 may be used to secure placement of bib 200. In other examples, magnets 106-112 may be replaced by another fastening mechanism or technique (e.g., snaps, buttons, Velcro or the like) that may be used to secure flaps 102-105 as described above in the exemplary configurations.

As shown here, magnets 106-112 may be used to fasten and secure bib 200 as described above. As an example, flap 103 may be placed in front of and overlapping flap 102, while magnet 106 may be lined up and mated, paired, or otherwise coupled ("coupled") with magnet 110, and magnet 108 may be lined up and coupled with magnet 112 to secure flap 103 to flap 102. In some examples, magnets 106-112 may be located on bib 200 substantially as shown in FIG. 2A. In other examples, magnets 106-112 may be located on bib 200 in other locations and using other configurations and are not limited to the locations and configurations as shown and described. In other examples, bib 200 and the above-described elements may be implemented differently and are not limited to the examples shown and described.

Figure 2B:
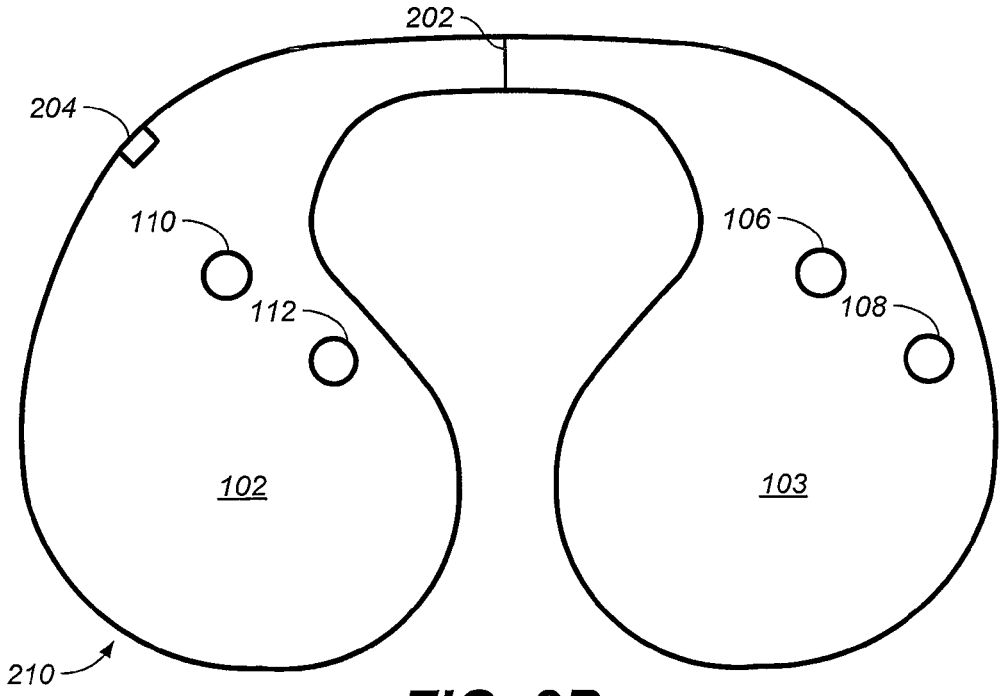
FIG. 2B illustrates another alternative view of an exemplary bib.

FIG. 2B illustrates another alternative view of an exemplary bib. Here, bib 210 may include flaps 102-103, magnets 106-112, neck bridge 202, and label 204 (e.g., use and care label). Bib 210 may be implemented similarly or substantially similar in function and structure to bib 200 as shown and described in FIG. 2A. As an example, bib 210 depicts an alternative configuration and location of magnets 106-112. In some examples, flaps 102-103 may be implemented similarly or substantially similar in function and structure to flaps 102-103 as shown and described in FIG. 1 and FIG. 2A. Further, magnets 106-112 may be implemented similarly or substantially similar in function and structure to magnets 106-112 as shown and described in FIG. 1 and FIG. 2A. Still further, neck bridge 202 may be implemented similarly or substantially similar in function and structure to neck bridges 114-116 as, shown and described in FIG. 1 and neck bridge 202 as shown and described in FIG. 2A. Still further, label 204 may be implemented similarly or substantially similar in function and structure to label 204 as shown and described in FIG. 2A.

As shown here, magnets 106-112 may be used to fasten and secure bib 210 as described above in FIG. 2A. As an example, flap 103 may be placed in front of and overlapping flap 102, while magnet 106 may be lined up and coupled with magnet 110, and magnet 108 may be lined up and coupled with magnet 112 to secure flap 103 to flap 102. In some examples, magnets 106-112 may be located on bib 210 substantially as shown in FIG. 2B. In other examples, magnets 106-112 may be located on bib 210 in other locations and other configurations and are not limited to the locations and configurations as shown and described. In other examples, bib 210 and the above-described elements may be implemented differently and are not limited to the examples shown and described.

Figure 3:
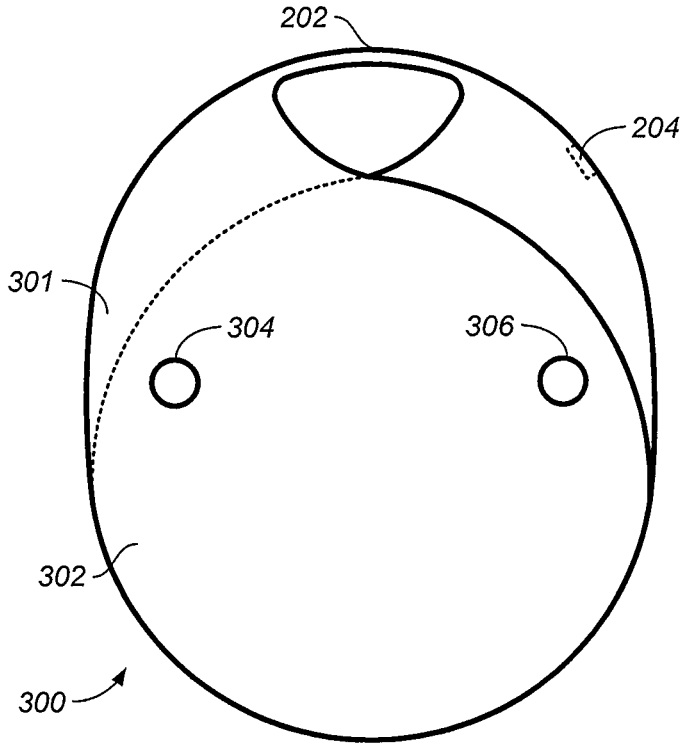
FIG. 3 illustrates a view of an exemplary bib in an alternative configuration.

FIG. 3 illustrates a view of an exemplary bib in an alternative configuration. Here, bib 300 may include flaps 301-302, neck bridge 202, label 204 and magnets 304-306. In some examples, label 204 may be implemented similarly or substantially similar in function and structure to label 204 as shown and described in FIG. 2A. Further, magnets 304-306 may be implemented similarly or substantially similar in function and structure to magnets 106-112 as previously shown and described in FIGS. 1-2B.

As shown here, bib 300 is depicted in an engaged configuration, or its position when being used or worn by wearer. Here, flap 302 is shown in front of flap 301, and magnets 304-306 are coupled with other respective magnets (not shown) to secure flap 302 to flap 301. Alternatively, flap 301 may be placed in front of flap 302, and secured with pairs of magnets 304-306 when worn or otherwise used. When worn, neck bridge 202 may be placed behind the neck of a wearer, and flaps 301-302 may be wrapped around the neck of the wearer until they are placed upon the upper torso of the wearer. When worn or placed in the described configuration, an opening or void is formed and surrounded or enclosed by neck bridge 202 and flaps 301-302. When bib 300 is worn, a wearer's neck may pass through or project through the opening. Bib 300 is secured or fitted upon a wearer by placing the opening around the wearer's neck. In other examples, bib 300 and the above-described elements may be implemented differently and are not limited to the examples shown and described.

Figure 4:
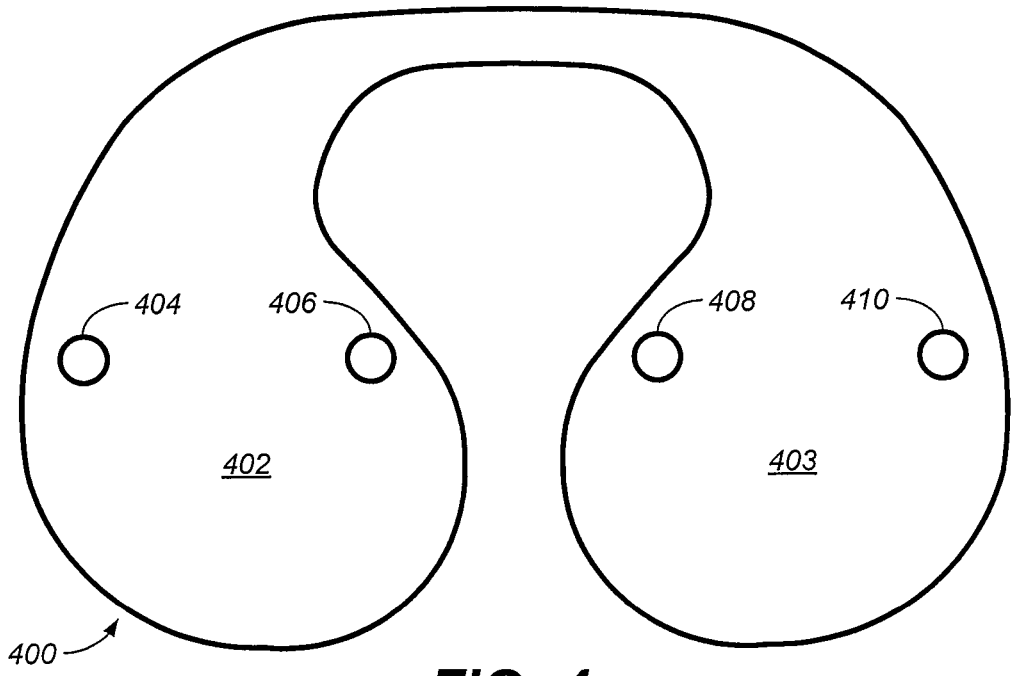
FIG. 4 illustrates another alternative view of an exemplary bib.

FIG. 4 illustrates another alternative view of an exemplary bib. Here, bib 400 may include flaps 402-403 and magnets 404-410. Bib 400 may be implemented similarly or substantially similar in function and structure to bib 200-210 and bib 300 as shown and described in FIGS. 2A-3. In some examples, flaps 402-403 may be implemented similarly or substantially similar in function and structure to flaps 102-103 as shown and described in FIG. 1 and FIGS. 2A-B. Further, magnets 404-410 may be implemented similarly or substantially similar in function and structure to magnets

106-112 as shown and described in FIG. 1 and FIGS. 2A-B. Alternatively, magnets 404-410 may be positioned, configured, designed, formed, or otherwise implemented differently. For example, magnets 404 and 408 may be positioned to prevent an edge of flap 402 from folding over due to extended wear or washing resulting in fabric weakness or structural stress of fabric 300. In other examples, bib 400 and the above-described elements may be implemented differently and are not limited to the examples shown and described.

Figure 5:
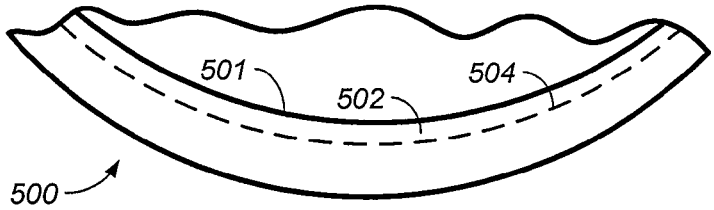
FIG. 5 illustrates an edge of an exemplary bib.

FIG. 5 illustrates an edge of an exemplary bib. As shown here, edge 500 includes fabric 501, distance 502, and stitch 504. In some examples, fabric 501 may be implemented similarly or substantially similar in function and structure to fabric 122 as shown and described in FIG. 1. Edge 500 illustrates an exterior edge or border of a bib (e.g., bib 100 (FIG. 1), 200 (FIG. 2A), 210 (FIG. 2B), 300 (FIG. 3), 400 (FIG. 4), or the like). In some examples, edge 500 may be located around the entire perimeter of flaps 102-105 (as shown and described in FIG. 1) and neck bridges 114-116 (as shown and described in FIG. 1). In other examples, edge 500 may be located in limited locations around the perimeter of flaps 102-105 and neck bridges 114-116. In other examples, edge 500 may not be included around a bib (e.g., bib 100 (FIG. 1), 200 (FIG. 2A), 210 (FIG. 2B), 300 (FIG. 3), 400 (FIG. 4), or the like) and another material, structure, or implement may be used around the perimeter of a bib (e.g., bib 100 (FIG. 1), 200 (FIG. 2A), 210 (FIG. 2B), 300 (FIG. 3), 400 (FIG. 4), or the like) to provide aesthetic, functional, protective, or finishing qualities to the bib. In still other examples, edge 500 may be removed from the border or outer perimeter of a bib, instead using stitching to couple, for example, flap 602 together.

As shown here, fabric 501 is attached to flaps 102-105 or neck bridges 114-116 by sewing, stitching, tying, knitting, knotting, gluing or other method of connection. Here, stitch 504 attaches and secures fabric 501 to the outside perimeter of the bib. In some examples, stitch 504 may be disposed distance 502 from the edge of fabric 501. In other examples, distance 502 may be 1.2 centimeters. In still other examples, distance 502 may be varied and is not limited to any specific length, distance, or other dimension. In some examples, stitch 504 may be implemented using a thread of any natural or synthetic fiber, including cotton, wool, silk, polyester, nylon, and various types of blends. In other examples, stitch 504 may be configured differently or provided at a different distance from the edge of fabric 501. In still other examples, stitch 504 may be excluded and fabric 501 may be attached, connected, or otherwise coupled ("coupled") to bib (e.g., bib 100 (FIG. 1), 200 (FIG. 2A), 210 (FIG. 2B), 300 (FIG. 3), 400 (FIG. 4), or the like) by a different means or method. In other examples, the above-described elements may be implemented differently and are not limited to the examples shown and described.

Figure 6:
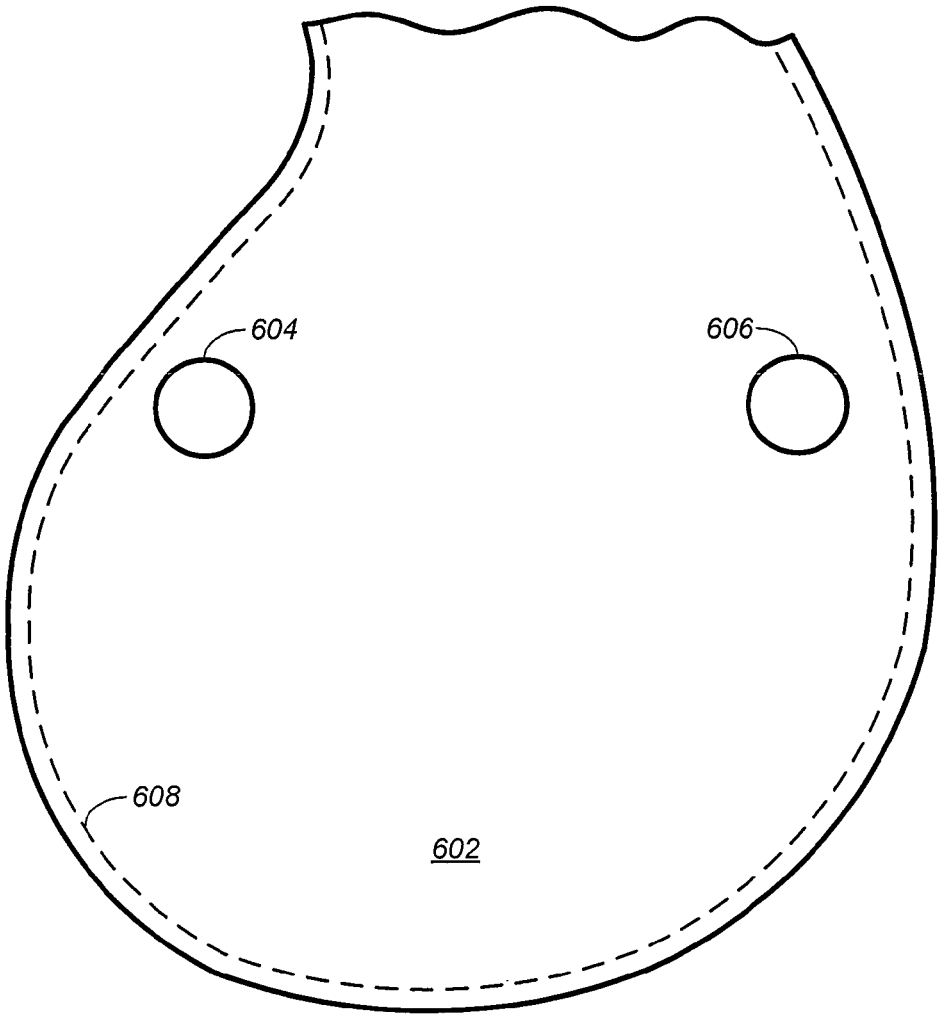
FIG. 6 illustrates a view of a flap of an exemplary bib.

FIG. 6 illustrates a view of a flap of an exemplary bib. Here, flap 602 may include magnets 604-606 and stitch 608. In some examples, flap 602 may be implemented similarly or substantially similar in function and structure to flaps 102-103 as shown and described in FIG. 1 and FIGS. 2A-B. Further, magnets 604-606 may be implemented similarly or substantially similar in function and structure to magnets 106-112 as shown and described in FIG. 1 and FIGS. 2A-B. Still further, stitch 608 may be implemented similarly or substantially similar in function and structure to stitch 502 as shown and described in FIG. 5. In other examples, more, fewer, or different elements (e.g., magnets 604-606) may be provided and laid out differently and are not limited to the examples shown.

Figure 7:
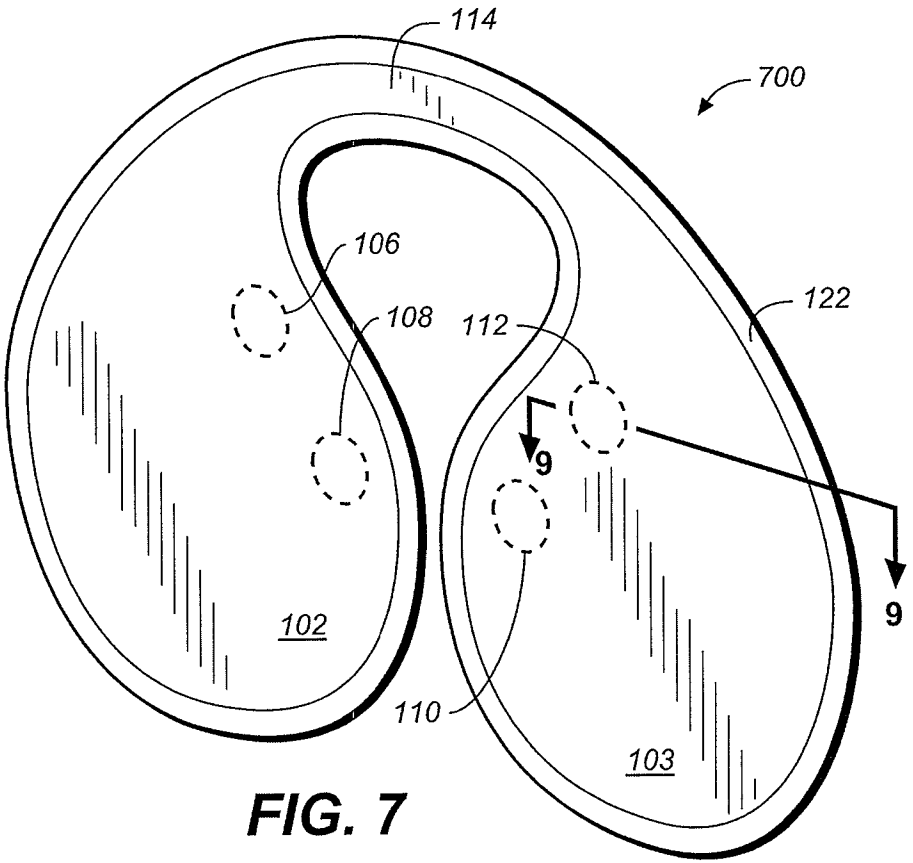
FIG. 7 illustrates a perspective view of an exemplary bib.

FIG. 7 illustrates a perspective view of an exemplary bib. Here, bib 700 is shown in a perspective view with flaps 102-103, magnets 106-112, neck bridge 114, and fabric 122. In some examples, flaps 102-103 may be implemented similarly or substantially similar in function and structure to flaps 102-103 as shown and described in FIG. 1 and FIGS. 2A-B, magnets 106-112 may be implemented similarly or substantially similar in function and structure to magnets 106-112 as shown and described in FIG. 1 and FIGS. 2A-B, neck bridge 114 may be implemented similarly or substantially similar in function and structure to neck bridge 114 as shown and described in FIG. 1 and fabric 122 may be implemented similarly or substantially similar in function and structure to fabric 122 as shown and described in FIG. 1. In other examples, the above-described elements may be implemented differently and are not limited to the examples shown and described.

Figure 8B:
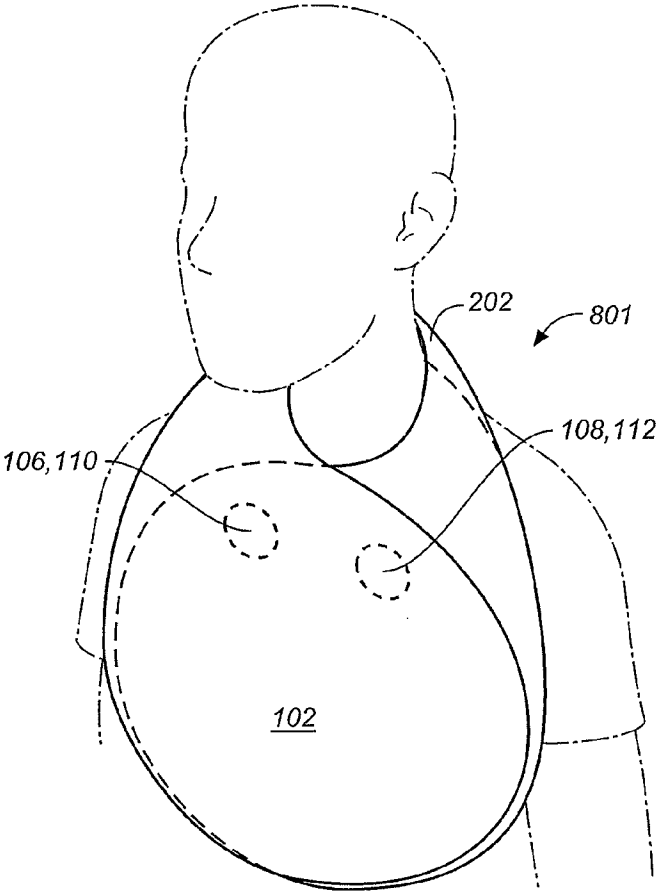
FIG. 8B illustrates a view of an exemplary bib in another alternative configuration.
Figure 8A:
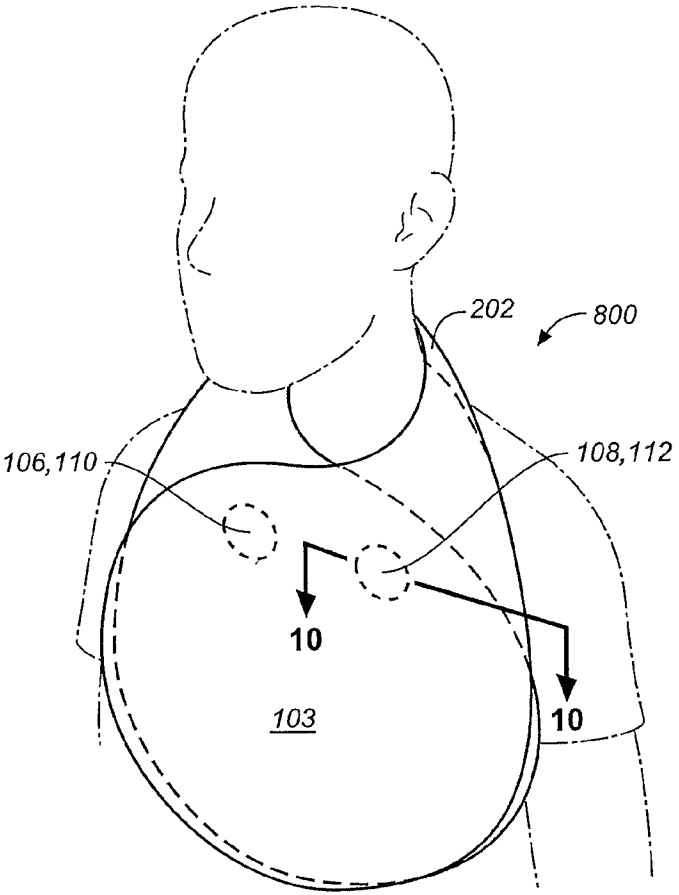
FIG. 8A illustrates a view of an exemplary bib in an alternative configuration.

FIG. 8A illustrates a view of an exemplary bib in an alternative configuration. Here, bib 800 may include flap 103, magnets 106-112 and neck bridge 202. In some examples, flap 103 may be implemented similarly or substantially similar in function and structure to flap 103 as shown and described in FIG. 1 and FIGS. 2A-2B, magnets 106-112 may be implemented similarly or substantially similar in function and structure to magnets 106-112 as shown and described in FIG. 1 and FIGS. 2A-2B and neck bridge 202 may be implemented similarly or substantially similar in function and structure to neck bridge 202 as shown and described in FIG. 2A-2B.

As shown here, bib 800 is depicted in an engaged configuration (i.e., being worn), or its position when being used or worn by wearer. Here, flap 103 is shown in "front," magnet 106 is mated (i.e., coupled) with magnet 110 and magnet 108 is mated with magnet 112. When worn, neck bridge 202 may be placed behind the neck of the wear, and flap 103 may be wrapped around the neck of the wearer until bib 800 is secured upon the upper torso of the wearer. In other examples, bib 800 and the above-described elements may be implemented differently and are not limited to the examples shown and described.

FIG. 8B illustrates a view of an exemplary bib in another alternative configuration. Here, bib 801 may include flap 102, magnets 106-112 and neck bridge 202. In some examples, flap 102 may be implemented similarly or substantially similar in function and structure to flap 102 as shown and described in FIG. 1 and FIGS. 2A-2B, magnets 106-112 may be implemented similarly or substantially similar in function and structure to magnets 106-112 as shown and described in FIG. 1 and FIGS. 2A-2B and neck bridge 202 may be implemented similarly or substantially similar in function and structure to neck bridge 202 as shown and described in FIG. 2A-2B.

As shown here, bib 801 is depicted in an alternative engaged configuration, or its position when being used or worn by wearer. Here, flap 102 is shown in "front," magnet 106 is mated with magnet 110 and magnet 108 is mated with magnet 112. In other examples, bib 801 and the above-described elements may be implemented differently and are not limited to the examples shown and described.

Figure 9:
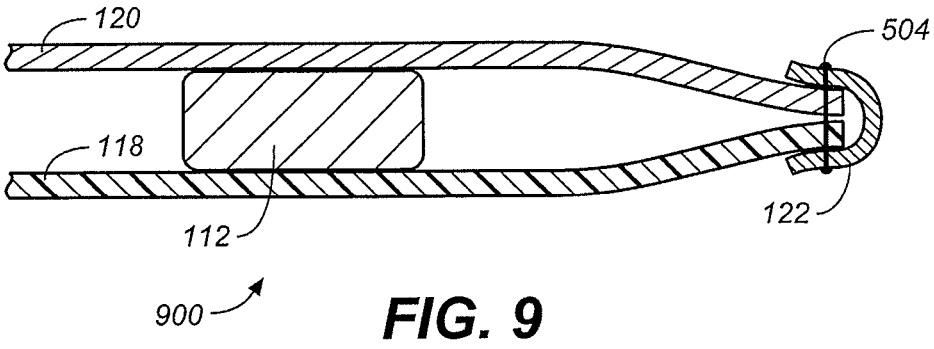
FIG. 9 illustrates a cross-sectional view of an exemplary bib.

FIG. 9 illustrates a cross-sectional view of an exemplary bib. As shown here, cross-sectional view 900 includes magnet 112, outer surface 118, reverse surface 120, fabric 122 and stitch 504. In some examples, magnet 112 may be implemented similarly or substantially similar in function and structure to magnet 112 as shown and described in FIG. 1 and FIGS. 2A-2B. Further, outer surface 118 may be implemented similarly or substantially similar in function and structure to outer surface 118 as shown and described in FIG. 1, reverse surface 120 may be implemented similarly or substantially similar in function and structure to reverse surface 120 as shown and described in FIG. 1, fabric 122 may be implemented similarly or substantially similar in function and structure to fabric 122 as shown and described in FIG. 1. Still further, stitch 504 may be implemented similarly or substantially similar in function and structure to stitch 504 as shown and described in FIG. 5. As shown here, magnet 112 may be placed between outer surface 118 and reverse surface 120, enabling the magnet to remain protected from exposure from food or other materials that may come into contact with outer surface 118 or reverse surface 120. In other examples, the above-described elements may be implemented differently and are not limited to the examples shown and described.

Figure 10:
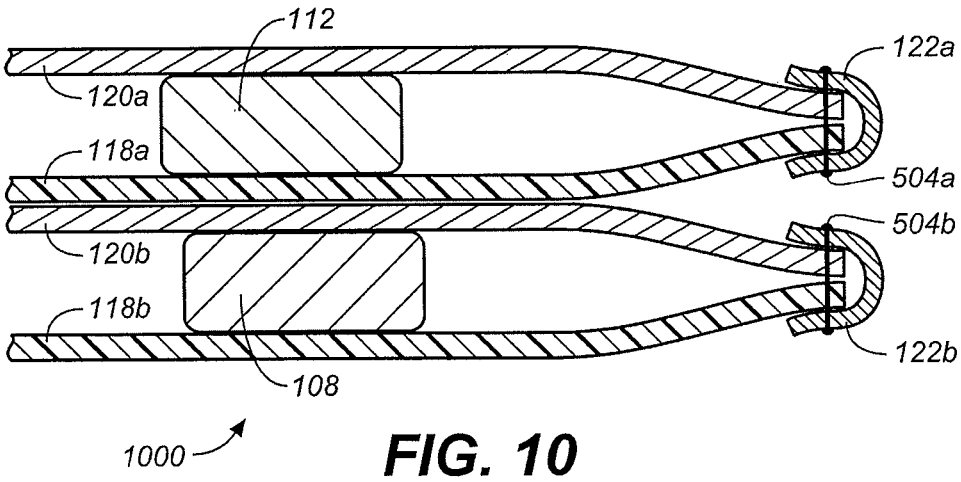
FIG. 10 illustrates another cross-sectional view of an exemplary bib.

FIG. 10 illustrates another cross-sectional view of an exemplary bib. As shown here, cross-sectional view 1000 includes magnet 108, magnet 112, outer surface 118*a*, outer surface 118*b*, reverse surface 120*a*, reverse surface 120*b*, fabric 122*a*, fabric 122*b* stitch 504*a* and stitch 504*b*. In some examples, magnet 108 and magnet 112 may be implemented similarly or substantially similar in function and structure to magnet 108 and magnet 112 as shown and described in FIG. 1 and FIGS. 2A-2B. Further, outer surface 118*a* and outer surface 118*b* may be implemented similarly or substantially similar in function and structure to outer surface 118 as shown and described in FIG. 1, reverse surface 120*a* and reverse surface 120*b* may be implemented similarly or substantially similar in function and structure to reverse surface 120 as shown and described in FIG. 1, fabric 122*a* and fabric 122*b* may be implemented similarly or substantially similar in function and structure to fabric 122 as shown and described in FIG. 1. Still further, stitch 504*a* and fabric 504*b* may be implemented similarly or substantially similar in function and structure to stitch 504 as shown and described in FIG. 5.

As shown here, magnet 108 may be placed between outer surface 118*b* and reverse surface 120*b*, and magnet 112 may be placed between outer surface 118*a* and reverse surface 120*a*. In some examples, magnet 108 may be disposed in an interior pocket (not shown) formed between outer surface 118*b* and reverse surface 120*b*, and magnet 112 may be disposed in an interior pocket formed between outer surface 118*a* and reverse surface 120*a*, the interior pocket being bounded by stitches or otherwise enclosed. In other examples, magnet 108 may be directly or indirectly attached or coupled to outer surface 118*b* or reverse surface 120*b* and magnet 112 may be directly or indirectly attached or coupled to outer surface 118*a* or reverse surface 120*a* by sewing, stitching, tying, knitting, knotting, gluing or using any other type or method of connection, coupling, or adhesion. In other examples, the above-described elements may be implemented differently and are not limited to the examples shown and described.

Figure 11:
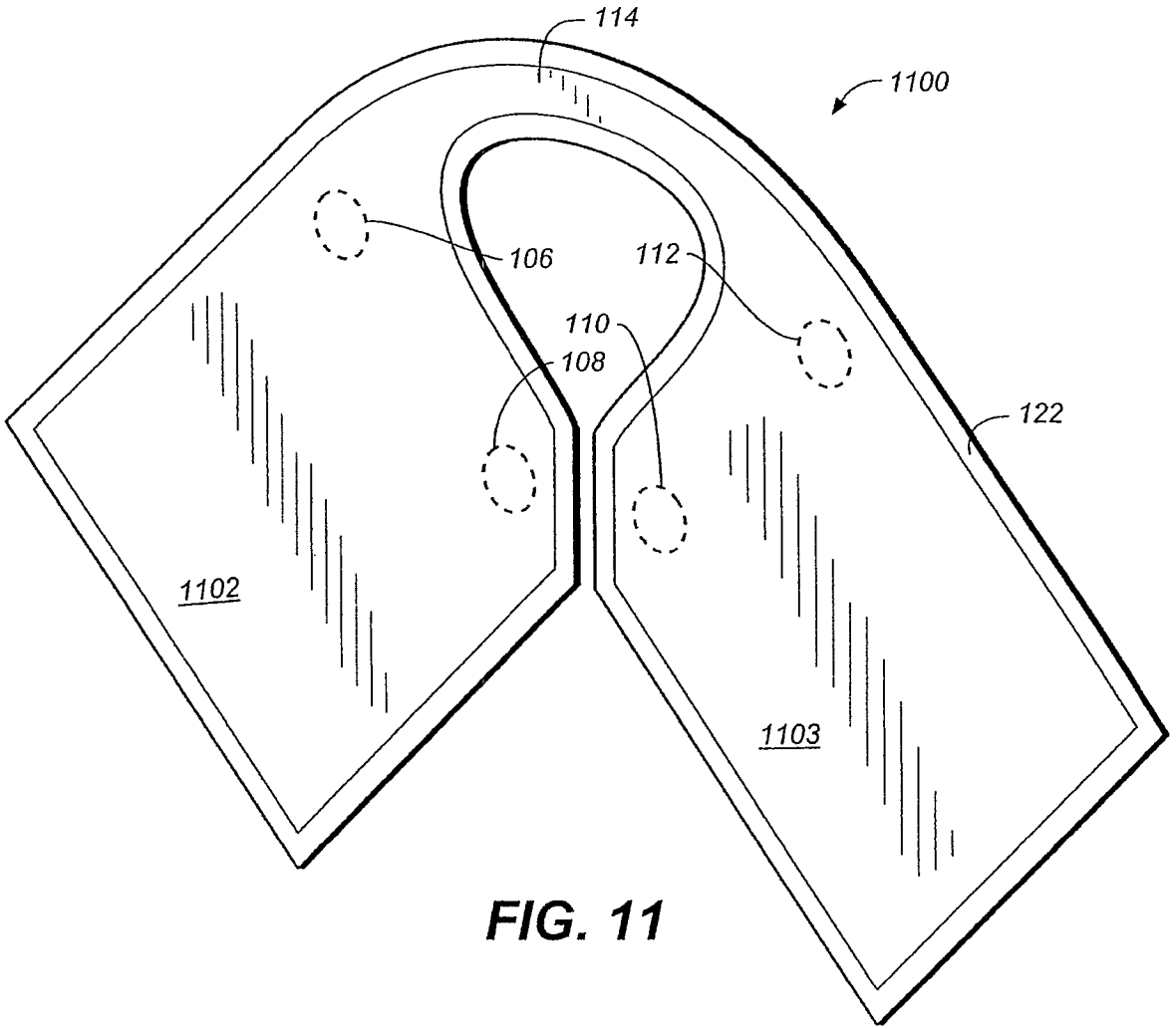
FIG. 11 illustrates another perspective view of an exemplary bib.

FIG. 11 illustrates another perspective view of an exemplary bib. Here, bib 1100 is shown in a perspective view with flaps 1102-1103, magnets 106-112, neck bridge 114, and fabric 122. In some examples, flaps 102-103 may be implemented similarly or substantially similar in function and structure to flaps 102-103 as shown and described in FIG. 1 and FIGS. 2A-B, magnets 106-112 may be implemented similarly or substantially similar in function and structure to magnets 106-112 as shown and described in FIG. 1 and FIGS. 2A-B, neck bridge 114 may be implemented similarly or substantially similar in function and structure to neck bridge 114 as shown and described in FIG. 1 and fabric 122 may be implemented similarly or substantially similar in function and structure to fabric 122 as shown and described in FIG. 1. As shown here, flaps 102-103 may be a substantially rectangular shape. In other examples, flaps 102-103 may be implemented using a circular, square, rectangular, triangular, parabolic or other geometric shape or design. In other examples, the above-described elements may be implemented differently and are not limited to the examples shown and described.

Figure 12B:
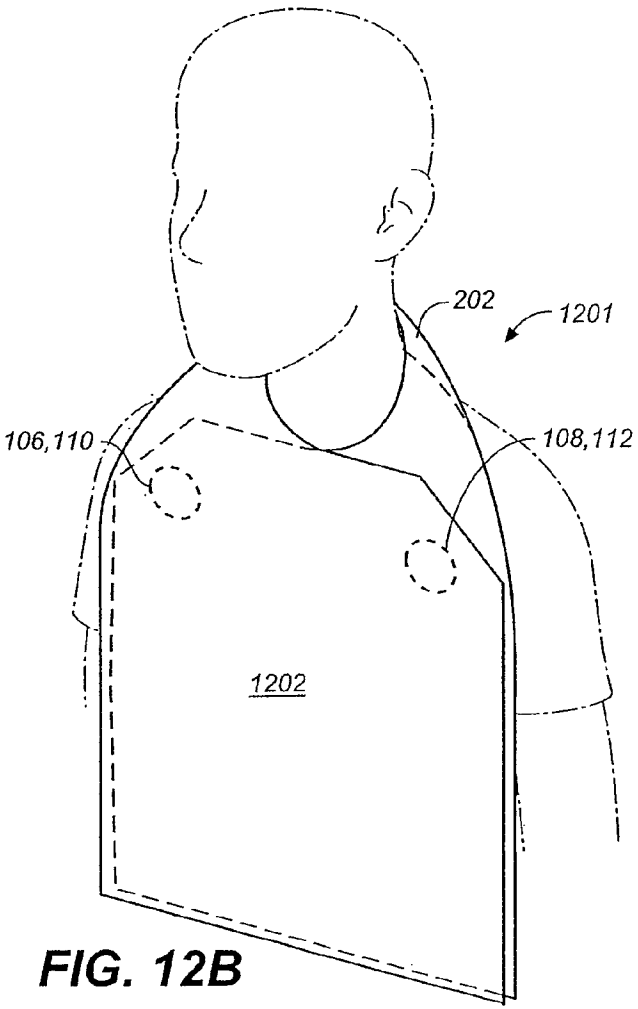
FIG. 12B illustrates another view of an exemplary bib in another alternative configuration.
Figure 12A:
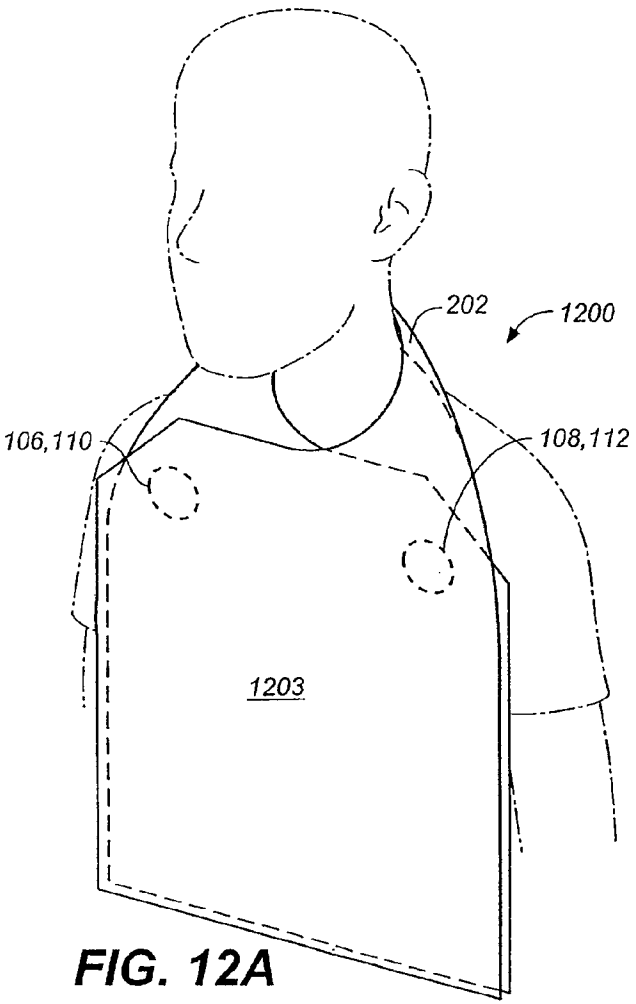
FIG. 12A illustrates another view of an exemplary bib in an alternative configuration.

FIG. 12A illustrates another view of an exemplary bib in an alternative configuration. Here, bib 1200 may include flap 103, magnets 106-112 and neck bridge 202. In some examples, flap 103 may be implemented similarly or substantially similar in function and structure to flap 103 as shown and described in FIG. 1 and FIGS. 2A-2B, magnets 106-112 may be implemented similarly or substantially similar in function and structure to magnets 106-112 as shown and described in FIG. 1 and FIGS. 2A-2B and neck bridge 202 may be implemented similarly or substantially similar in function and structure to neck bridge 202 as shown and described in FIG. 2A-2B.

As shown here, bib 1200 is depicted in an engaged configuration, or its position when being used or worn by wearer. Here, flaps 1202-1203 are shown as a substantially rectangular shape. Further, flap 1203 is shown disposed in "front" of another flap (e.g., flap 1202) magnet 106 is mated with magnet 110 and magnet 108 is mated with magnet 112. When worn, neck bridge 202 may be placed behind the neck of the wear, and flap 103 may be wrapped around the neck of the wearer until bib 1200 is secured upon the upper torso of the wearer. In other examples, bib 1200 and the above-described elements may be implemented differently and are not limited to the examples shown and described.

FIG. 12B illustrates another view of an exemplary bib in another alternative configuration. Here, bib 1201 may include flap 1202, magnets 106-112 and neck bridge 202. In some examples, flap 1202 may be implemented similarly or substantially similar in function and structure to flap 1202 as shown and described in FIG. 1 and FIGS. 2A-2B, magnets 106-112 may be implemented similarly or substantially similar in function and structure to magnets 106-112 as shown and described in FIG. 1 and FIGS. 2A-2B and neck bridge 202 may be implemented similarly or substantially similar in function and structure to neck bridge 202 as shown and described in FIG. 2A-2B.

As shown here, bib 1201 is depicted in an alternative engaged configuration, or its position when being used or worn by wearer. Here, flap 1202 is shown in "front," magnet 106 is mated with magnet 110 and magnet 108 is mated with magnet 112. In other examples, bib 1201 and the above-described elements may be implemented differently and are not limited to the examples shown and described.

As set forth above, measurements, dimensions, or other specifications may be varied and are not limited to those previously described. Variations in sizes, shapes, and processes may also be implemented and the above-described examples are also not intended to be limiting.

The foregoing examples have been described in some detail for purposes of clarity of understanding, but are not limited to the details provided. There are many alternative ways and techniques for implementation. The disclosed examples are illustrative and not restrictive.

What is claimed:

1. A bib, comprising:

two flaps each having a first surface that can be outward facing and a second surface that can be outward facing, the two flaps designed to substantially overlap such that a top flap substantially covers a bottom flap when the bib is worn;

a neck bridge coupling the two flaps, the neck bridge having two ends, a first flap attached to a first end of the neck bridge, and a second flap attached to the second end of the neck bridge; and a fastener to couple the two flaps to each other in a plurality of configurations, such that the fastener securely fastens the two flaps to each other, in the substantially covering position, with either flap being the top flap.

2. The bib of claim 1, wherein the two flaps are symmetrical.

3. The bib of claim 2, wherein the fastener comprises one or more of: a magnet, a hook and eye, a snap, hook and loop fastener, or a button.

4. The bib of claim 1, wherein the first surface is comprised of one or more of: a water repellent material, a magnetic material, and a soft material.

5. The bib of claim 1, wherein the two flaps and the neck bridge are formed from a single monolithic piece of material.

6. The bib of claim 1, wherein the two flaps are substantially the same shape.

7. The bib of claim 1, wherein the fastener is positioned to prevent an edge of the two flaps from folding over during use of the bib.

8. The bib of claim 1, wherein the bib has at least three surfaces that may be in front when the bib is worn.

9. The bib of claim 1, wherein the bib further comprises an edge fabric comprised of a shape retaining material.

10. The bib of claim 9, wherein the edge fabric is stitched along a perimeter associated with the first surface and the second surface.

11. The bib of claim 1, wherein the configuration of the bib may be changed to enable the bib to appear clean when one of the surfaces is soiled.

12. A bib, comprising:

two flaps designed to overlap when worn, a flap having two surfaces which may be outward facing when the bib is worn and a first neck bridge coupled to a first flap on one end, and coupled to a second flap on another end, the neck bridge coupling together the two flaps;

a fastener designed to couple the two flaps to each other when the bib is worn;

when worn, a top flap substantially covers a bottom flap, and the fastener securely fastens the top flap to the bottom flap when either of the two flaps is the top flap, such that the bib has at least three surfaces that may be in front, when the bib is worn, enabling the bib to appear clean when one of the surfaces is soiled.

13. The bib of claim 12, wherein the fastener is positioned to prevent an edge of one of the two flaps from folding over during use of the bib.

14. The bib of claim 12, wherein the two flaps are made from a protective material designed to protect clothing from stains.

15. The bib of claim 12, wherein the bib further comprises an edge fabric comprised of a shape retaining material.

16. The bib of claim 12 wherein the fastener comprises one of: a button, a hook and loop, hook and loop fastener, a magnet, a snap.

17. A bib, comprising:

two interchangeable flaps coupled to either end of a neck bridge, each flap including a surface that can be outward facing, and at least one flap including two surfaces that can be outward facing;

a fastener designed to couple the two interchangeable flaps to each other in at least two configurations when the bib is worn, such that a top flap substantially covers a bottom flap, and the fastener securely coupling the two flaps with either of the two interchangeable flaps being used as the top flap.

18. The bib of claim 17, wherein a flap includes two surfaces that can be outward facing.

19. A bib comprising:

a neck bridge designed to fit behind the neck, having a first end and a second end;

a first flap coupled to the first end of the neck bridge, the first flap having two surfaces that can face outward;

a second flap coupled to the second end of the neck bridge, the second flap having a surface that can face outward;

a fastener designed to securely fasten the first flap to the second flap when the bib is worn, in a plurality of configurations, such that a top flap substantially covers a bottom flap, wherein the top flap may be the first flap or the second flap.

20. The bib of claim 19, wherein the neck bridge, first flap, and second flap are made from one of: a single piece of fabric or multiple pieces of fabric.

21. The bib of claim 19, wherein the fastener comprises one or more of: a magnet, a hook and eye, a snap, hook and loop fastener, or a button.

* * * * *